US011441389B2

(12) United States Patent
Hunter

(10) Patent No.: US 11,441,389 B2
(45) Date of Patent: Sep. 13, 2022

(54) METHODS AND SYSTEMS FOR A VENT WITHIN A TOOL POSITIONED WITHIN A WELLBORE

(71) Applicant: COMITT WELL SOLUTIONS US HOLDING INC., Katy, TX (US)

(72) Inventor: William Hunter, Houston, TX (US)

(73) Assignee: Comitt Well Solutions LLC, Katy, TX (US)

( * ) Notice: Subject to any disclaimer, the term of this patent is extended or adjusted under 35 U.S.C. 154(b) by 7 days.

(21) Appl. No.: 17/189,466

(22) Filed: Mar. 2, 2021

(65) Prior Publication Data

US 2021/0189834 A1 Jun. 24, 2021

Related U.S. Application Data

(63) Continuation of application No. PCT/US2019/054279, filed on Oct. 2, 2019.

(60) Provisional application No. 62/743,302, filed on Oct. 9, 2018.

(51) Int. Cl.
*E21B 34/14* (2006.01)
*E21B 34/10* (2006.01)

(52) U.S. Cl.
CPC ..... *E21B 34/14* (2013.01); *E21B 34/10* (2013.01); *E21B 2200/06* (2020.05)

(58) Field of Classification Search
CPC .... E21B 34/14; E21B 43/267; E21B 2200/06; E21B 34/10; E21B 1/00; E21B 43/12; E21B 43/26; E21B 21/03; E21B 23/04; E21B 23/0416; E21B 23/12; E21B 34/08; E21B 2200/02
See application file for complete search history.

(56) References Cited

U.S. PATENT DOCUMENTS

| | | | | |
|---|---|---|---|---|
| 5,890,540 | A * | 4/1999 | Pia | E21B 23/006 166/321 |
| 6,095,249 | A * | 8/2000 | McGarian | E21B 34/102 166/324 |
| 9,145,748 | B1 * | 9/2015 | Meier | E21B 21/103 |
| 10,533,388 | B2 * | 1/2020 | Wesson | E21B 21/103 |
| 2007/0151737 | A1 * | 7/2007 | Begley | E21B 34/14 166/324 |
| 2018/0245426 | A1 * | 8/2018 | Strohla | E21B 33/14 |
| 2019/0136653 | A1 * | 5/2019 | Hern | E21B 21/103 |

* cited by examiner

*Primary Examiner* — Michael R Wills, III
(74) *Attorney, Agent, or Firm* — Pierson IP, PLLC

(57) ABSTRACT

Utilizing a fluid flow rate within a tool to close and open a vent extending through a circumference of the tool. The vent may be positioned above a packer pair that is configured to extend across an annulus. The tool may include a vent, sliding sleeve, adjustable member, and plunger.

20 Claims, 3 Drawing Sheets

METHODS AND SYSTEMS FOR A VENT WITHIN A TOOL POSITIONED WITHIN A WELLBORE

BACKGROUND INFORMATION

Field of the Disclosure

Examples of the present disclosure relate to systems and methods for a vent positioned within a wellbore. More specifically, embodiments relate to a vent through the circumference of the tool positioned above a packer pair.

Background

Hydraulic injection is a method performed by pumping fluid into a formation at a pressure sufficient to create fractures in the formation. When a fracture is open, a propping agent may be added to the fluid. The propping agent, e.g. sand or ceramic beads, remains in the fractures to keep the fractures open when the pumping rate and pressure decreases.

To create sufficient pressure to create fractures within the geological formation, straddle packers may isolate an area within the formation. Conventionally a pressure differential is utilized to set the packers. However, when creating the pressure differential to set the packers, a column of fluid is created within the tool.

This creates issues when trying to unset the packers, which require an equalized pressure differential. Conventionally, to equalize the pressure differential, systems pump fluid within the annulus to equal the column of fluid within the tool. However, this requires time and additional fluid.

Accordingly, needs exist for systems and methods for fracturing systems with a vent that is configured to rapidly equalize a pressure within an annulus above a straddle packer pair and an inner diameter of a tool based on a fluid flow rate through the inner diameter of the tool.

SUMMARY

Examples of the present disclosure relate to systems and methods utilizing a fluid flow rate within a tool to open and close a vent extending through a circumference of the tool. In embodiments, the vent may be positioned above a packer pair, wherein the packer pair is configured to extend across an annulus to isolate an area of interest. The tool may include a vent, sliding sleeve, adjustable member, and plunger.

The vent may include a plurality of orifices positioned proximate to a distal end of the tool, wherein the plurality of orifices extend through a circumference of the tool. The plurality of orifices may be configured to allow communication between an annulus positioned outside of the tool and the inner diameter of the tool. In an open mode, a distal end of the sliding sleeve may be offset from the vent and closer to the surface than the vent, which allows the vent to be exposed allowing communication between the inner diameter of the tool and the annulus. In a closed mode, the distal end of the sliding sleeve may be aligned with the vent and further downhole than the vent, which may cover the vents and not allow communication between the inner diameter of the tool and the annulus.

The sliding sleeve may be positioned within the inner diameter of the tool, and may be configured to slide between the proximal end and the distal end of the tool. In embodiments, the sliding sleeve may move towards the distal end of the tool responsive to a fluid flow rate within the tool being above a first predetermined threshold, wherein when moving towards the distal end of the tool the sliding sleeve may cover the vent. The sliding sleeve may return towards the proximal end of the tool responsive to the fluid flow rate within the tool decreasing below a second predetermined threshold, wherein when returning towards the proximal end of the tool the sliding sleeve may uncover the vent.

The adjustable member may be configured to compress and elongate based on the fluid flow rate within the tool. Responsive to the fluid flow rate being above the first threshold, the adjustable member may compress. Responsive to the fluid flow rate being below the second threshold, the adjustable member may elongate from the compressed state to an elongated state. In embodiments, the adjustable member may be coupled to the sliding sleeve, wherein the sliding sleeve may move responsive to the adjustable member compressing and elongated. When the adjustable member compresses, the sliding sleeve may move towards the distal end of the tool, and when the adjustable member elongates the sliding sleeve may move towards the proximal end of the tool.

The plunger may be a device positioned between the sliding sleeve and the proximal end of the tool. The plunger may be configured to control the fluid flow rate through the inner diameter of the tool. Responsive to the sliding sleeve moving the plunger may correspondingly move. The plunger may include a nozzle, first passageway, and second passageway. The nozzle may have a first sized first end and a second sized second end. The varying of sizing between the ends of the nozzles enables the fluid flow rate between the proximal end of the tool and the nozzle to be different than the flow rate between the nozzle and the distal end of the tool. This changing of flow rate on opposite sides of the plunger enables the moving of the sliding sleeve based on a ratio between the first sized first end and the second sized second end. The first passageway may be positioned along a central axis of the plunger, through the nozzle, in a straight path. The first passageway may be accessible when the vent is opened or closed. The second passageway may be positioned around the central axis of the plunger, and around an outer diameter of the plunger. In embodiments, the second passageway may be closed when the vent is covered, and the second passageway may be open when the vent is covered. When both the first and second passageway are open, the second passageway may allow for more fluid to flow through the tool than through the first passageway.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
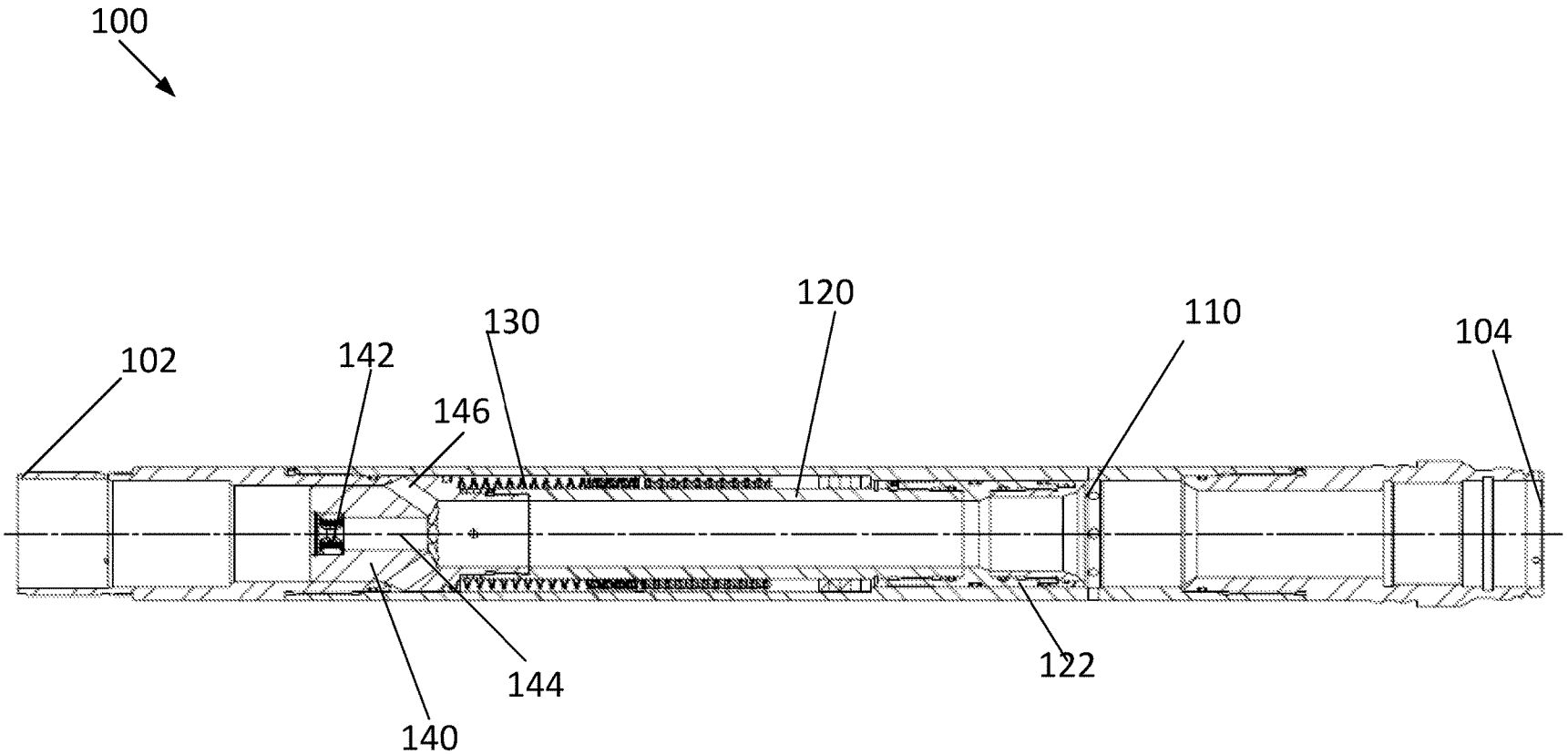
FIG. 1 depicts a tool in a first mode where vent is open, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art, that the specific detail need not be employed to practice the present embodiments. In other instances, well-known materials or methods have not been described in detail in order to avoid obscuring the present embodiments.

FIG. 1 depicts a tool 100 in a first mode, wherein vent 110 may be open, according to an embodiment. In the first mode, tool 100 may be configured to allow fluid to flow through a central axis of tool 100 and through vent 110. In embodiments, a sufficient pressure differential may be created between an annulus outside of tool 100 and an inner diameter of tool 100 to set a pair of straddle packers, wherein tool 100 is positioned closer to the wellbore surface than the packer pair. After the set of straddle packers are set, a zone within a geological formation may be isolated and fracturing and production processes may occur within the isolated zone. After the fracturing process, a fluid flow rate through the inner diameter of tool 100 may be decreased, which exposes vents 110. This may allow a first fluid level within the inner diameter of tool 100 to rapidly be substantially similar to a second fluid level within the annulus above the packer pair. Responsive to the fluid levels being substantially similar, the packer pair may unset. More specifically, by rapidly equalizing the column of fluid within the annulus and within the tool, the packers associated with the tool may be more quickly unset by limiting outside forces impacting the setting of the packer pair.

Tool 100 may include a vent 110, sliding sleeve 120, adjustable member 130, and plunger 140.

Vent 110 may be positioned above the packer pair (not shown) and adjustable member 130. Vent 110 may include a plurality of orifices extending from an inner circumference of tool 100 to an outer circumference of tool 100. The plurality of orifices may allow communications of fluid between the annulus outside of tool 100 and the inner diameter of tool. In embodiments, fluid positioned within the inner diameter of tool 100 may exit tool 100 through vents 110 to be positioned within an annulus. This may assist in equalizing a fluid level within the annulus above the pair of packers and within the inner diameter of tool 100.

Sliding sleeve 120 may be positioned within the inner diameter of tool 100. Sliding sleeve 120 may be configured to move between a proximal end 102 of tool 100 and a distal end 104 of tool 100. In embodiments, sliding sleeve 120 may move towards distal end 104 to cover vent 110, and sliding sleeve 120 may move towards proximal end 102 to uncover vent 110. Sliding sleeve 120 may be coupled to adjustable member 130. When sliding sleeve 120 moves towards distal end 104 of tool 100, adjustable member 130 may compress. When there is no fluid flowing through the inner diameter of the tool 100, adjustable member 130 may elongate, and assist in moving sliding sleeve 120 towards proximal end 102 of tool 100. In embodiments, a distal end of sliding sleeve 120 may include a seal 122 that is configured to form a seal 122 on a projection on tool 100 when sliding sleeve 120 is closed, wherein the seal 122 is between the outer diameter of sliding sleeve 120 and an inner diameter of tool 100. This may assist in isolating the annulus from the inner diameter of tool 100.

Seal 122 may be configured to be positioned adjacent to and/or below vents 110 when sliding sleeve 120 is moved towards distal end 104 of tool 100. Seal 122 may have a length that is greater than that of a circumference of the plurality of orifices of vent 110. This may limit, restrict, etc. the amount of fluid that can be communicated between the inner diameter of tool 100 and the annulus.

Adjustable member 130 may be a device, spring, fluid chamber, etc. that is configured to allow sliding sleeve 120 to move in a direction in parallel with a central axis of tool 100 based on a fluid flow rate within tool 100. Adjustable member 130 may apply a constant spring force from the distal end 104 towards proximal end 102 of tool 100. Responsive to increasing a fluid flow rate within the inner diameter of tool 100 passed a first flow rate threshold, adjustable member 130 may compress from a resting state, wherein the first flow rate threshold generates a force greater than the spring force. When adjustable member 130 compresses, sliding sleeve 120 may move towards distal end 104. Responsive to decreasing the fluid flow rate within past a second flow rate threshold, adjustable member 130 may elongate from the compressed state to the resting state, wherein the second flow rate threshold generates a force less than the spring force. When adjustable member 130 elongates to return to a resting state, sliding sleeve 120 may move towards proximal end 102.

Plunger 140 may be a device positioned between sliding sleeve 120 and proximal end 102 of tool 100. Plunger 140 may be configured to control a fluid flow rate and fluid flow path through the inner diameter of tool 100. Plunger 140 may have a distal end that is configured to be coupled with a proximal end of sliding sleeve 120. Plunger 140 may be configured to move responsive to sliding sleeve 120 moving.

Plunger 140 may have a nozzle 142, first passageway 144, and second passageway 146.

Nozzle 142 may be aligned with the central axis of tool 100, and may be configured to control a fluid flow rate through nozzle 142. Nozzle 142 may control the fluid flow rate through nozzle 142 based on having a first end with a first cross sectional area and a second end with a second cross sectional area, wherein the first cross sectional area and the second cross sectional area are different and the first cross sectional area is larger than the second cross sectional area. This may enable a first fluid flow rate between proximal end 102 of tool 100 and a first side of nozzle 142 to be different than a second fluid flow rate between the distal end 104 of tool 100 via a Venturi effect. This may enable adjustable member 130 to compress and decompress based on the fluid flow rate through nozzle 142.

First passageway 144 may extend through a central axis of plunger 140, which may extend through nozzle 142. First passageway 144 may be configured to be open when fluid is flowing through tool 100.

Second passageway 146 may be positioned outside of a body of plunger 140 around nozzle 142, and may be opened and closed based on the positioning of plunger 140. When vent 110 is open, plunger 140 may be positioned within a cavity of tool 100, such that the outer circumference of plunger 140 is positioned adjacent to the inner sidewalls of the cavity. This may limit the amount of fluid that may flow through the second passageway 146. Responsive to sliding sleeve 120 moving towards distal end 104, plunger 140 may move away from the cavity. This may expose the second passageway 146, allowing fluid flow through the second passageway 146.

In embodiments, second passageway 146 may include an angled channel on a distal end of second passageway, wherein the channel is angled from an inner circumference of the tool 100 towards a central axis of tool 100 from proximal end 102 towards distal end 104. The angling of the channel may allow for a path of least resistance when the fluid flows around the outer sidewalls of plunger 142 and through second passageway 146. This may limit the amount of erosion caused by the fluid flow and may limit the reduction of speed of the fluid flow. Furthermore, the angling of second passageway based on the geometry of plunger 142 may allow for the directional and angular control of fluid flowing around plunger 142. Specifically, the positioning and angularity of the distal end of second passageway may control the directional flow of the fluid, while also creating a larger cross sectional area between the inner diameter of tool 100 and the outer diameter of plunger 142.

Figure 2:
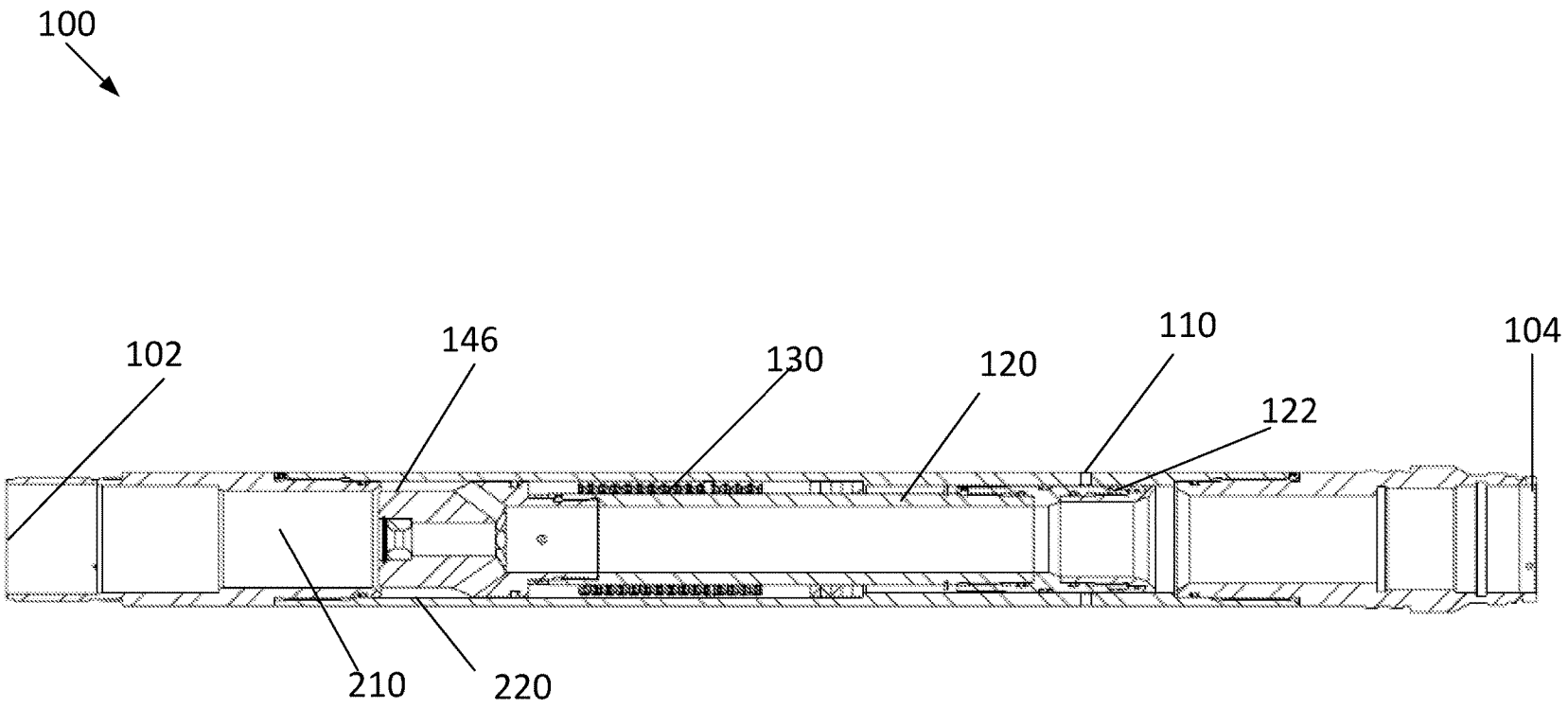
FIG. 2 depicts a tool in a second mode where vent is closed, according to an embodiment.

FIG. 2 depicts tool 100 in a second mode, wherein vent 110 may be closed, according to an embodiment. Elements depicted in FIG. 2 may be described above. For the sake of brevity, a further description of these elements is omitted.

As depicted in FIG. 2, responsive to the flow rate of fluid flowing through the inner diameter of the tool 100 increases to be greater than the first flow rate threshold, a force generated by the flowing fluid may be greater than the spring force of the adjustable member 130, wherein the spring force may be directed from distal end 104 towards proximal end 102. Based on the differences in forces in opposite directions, sliding sleeve 120 may move towards distal end 104 causing adjustable member 130 to compress.

When sliding sleeve 120 moves towards distal end 104, seal 122 extends across vent 110, which limits the communication between the inner diameter of tool 100 and the annulus. Furthermore, when sliding sleeve 120 moves towards distal end 104, plunger 140 may no longer be positioned within a first cavity 210, and may be positioned within a second cavity 220. Second cavity 220 may have a greater diameter than that of first cavity 210. This may enable fluid to flow through the second passageway 146, wherein second passageway 146 is positioned between an inner diameter of tool 100 and an outer diameter of plunger 142. Responsive to the fluid flowing through the first passageway 144 and second passageway 146, the fluid flow rate through the inner diameter of tool 100 may increase.

In embodiments, responsive to the fluid flow rate through the inner diameter of tool 100 decreasing to be lower than the flow rate threshold, the spring force applied by adjustable member 130 may be greater than the force generated by the flow rate. This may cause adjustable member 130 to elongate, moving sliding sleeve 120 and plunger 140 towards proximal end 102. When adjustable member 130 returns to its resting state, seal 122 may no longer cover vent 110. This may allow fluid to be communicated between the annulus and the inner chamber, allowing a first column of fluid within an annulus to be equalized rapidly with a second column of fluid positioned within tool 100.

Figure 3:
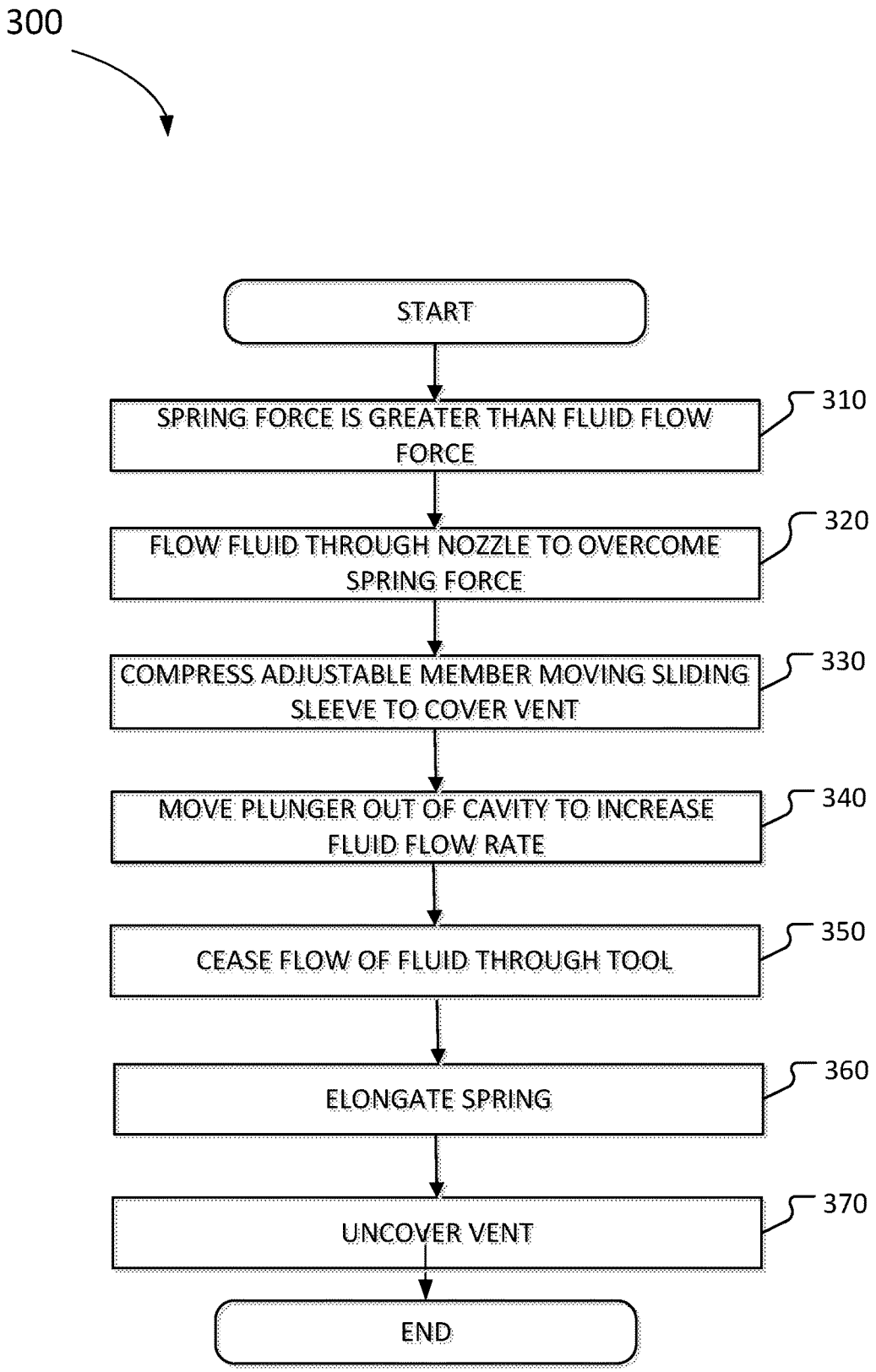
FIG. 3 depicts a method for a system utilizing a fluid flow rate to cover and uncover a vent within a tool, according to an embodiment.

FIG. 3 depicts a method 300 for a system utilizing a fluid flow rate to cover and uncover a vent within a tool, according to an embodiment. The operations of method 300 presented below are intended to be illustrative. In some embodiments, method 300 may be accomplished with one or more additional operations not described, and/or without one or more of the operations discussed. Additionally, the order in which the operations of method 300 are illustrated in FIG. 3 and described below is not intended to be limiting. Furthermore, the operations of method 300 may be repeated for subsequent valves or zones in a well.

At operation 310, there may be no fluid flowing through an inner diameter of a tool. When there is no fluid flowing through the inner diameter of the tool, a spring force generated by an adjustable member may be greater than a fluid flow force generated by fluid flowing through the inner diameter of the tool. In embodiments, the spring force may be in a direction from the distal end of the tool towards the proximal end of the tool.

At operation 320, fluid may flow in a first flow path through a nozzle through the tool at a rate that is generated a fluid flow force that is greater than the spring force, wherein the fluid flow force is in an opposite direction of the spring force.

At operation 330, when the fluid flow force is greater than the spring force the adjustable member may compress and a sliding sleeve may move towards the distal end of the tool. This may cause a seal on the sliding sleeve to cover a vent.

At operation 340, when the sliding sleeve moves towards the distal end, a plunger on a proximal end of the sliding sleeve may be positioned outside of a cavity within the tool exposing a secondary flow path through the inner diameter of the tool around the plunger. In embodiments, the secondary flow path may allow more fluid to flow at a higher flow rate than through the inner diameter of the tool than the first flow path.

At operation 350, the flowing of fluid through the inner diameter of the tool may cease.

At operation 360, responsive to decreasing the fluid flow rate, the spring force may be greater than the force generated by the flowing fluid. This may allow the spring to elongate.

At operation 370, when the spring elongates the sliding sleeve may move towards the proximal end of the tool, which may uncover the vent. This may allow fluid to flow between the annulus and the inner diameter of the tool.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale. For example, in embodiments, the length of the dart may be longer than the length of the tool.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A system for a downhole tool comprising:

a vent extending from an inner diameter of the downhole tool to an outer diameter of the downhole tool;

a sliding sleeve configured to move to cover and uncover the vent;

a plunger positioned on the sliding sleeve, the plunger having a first passageway for fluid, and the plunger being configured to create a second passageway for fluid, the first passageway extending through the plunger, the second passageway extending between an outer surface of the plunger and an inner sidewall of the downhole tool, the first passageway having a first inlet being exposed to a central bore of the downhole tool above the plunger, the first passageway having a first outlet being exposed to the central bore of the downhole tool below the plunger, the second passageway having a second inlet being exposed to the central bore of the downhole tool above the plunger, the second passageway having a second outlet being exposed to the central bore of the downhole tool below the plunger;

a device configured to apply a first force against the sliding sleeve, wherein the sliding sleeve moves from a first mode to a second mode based on the first force and a second force associated with fluid flowing through the inner diameter of the downhole tool.

2. The system of claim 1, wherein the first passageway extends along a central axis of the downhole tool, the first passageway having a proximal end with a first cross sectional area and a distal end with a second cross sectional area, the first cross sectional area being different than the second cross sectional area.

3. The system of claim 2, wherein the first cross sectional area and the second cross sectional area create a Venturi effect, wherein a first pressure rating associated with the first cross sectional area is different than a second pressure rating associated with the second cross sectional area.

4. The system of claim 2, wherein in the first mode the vent is configured to allow a first column of fluid within the tool to be equalized with a second column of fluid positioned within an annulus.

5. The system of claim 2, wherein the first passageway is open in the first mode and the second mode.

6. A system for a downhole tool comprising:

a vent extending from an inner diameter of the downhole tool to an outer diameter of the downhole tool;

a sliding sleeve configured to move to cover and uncover the vent;

a plunger positioned on the sliding sleeve, the plunger having a first passageway and being configured to create a second passageway for fluid;

a device configured to apply a first force against the sliding sleeve, wherein the sliding sleeve moves from a first mode to a second mode based on the first force and a second force associated with fluid flowing through the inner diameter of the downhole tool, wherein the second passageway is configured to be closed in a first mode when the sliding sleeve does not cover the vent, and the second passageway is configured to be open in a second mode when the sliding sleeve covers the vent.

7. The system of claim 6, wherein a second end of the plunger is angled towards the central axis of the downhole tool.

8. A system for a downhole tool comprising:

a vent extending from an inner diameter of the downhole tool to an outer diameter of the downhole tool;

a sliding sleeve configured to move to cover and uncover the vent;

a plunger positioned on the sliding sleeve, the plunger having a first passageway for fluid and a second passageway for fluid, the first passageway extending through the plunger, the second passageway extending between an outer surface of the plunger and an inner sidewall of the downhole tool, the first passageway having a first inlet being exposed to a central bore of the downhole tool above the plunger, the first passageway having a first outlet being exposed to the central bore of the downhole tool below the plunger, the second passageway having a second inlet being exposed to the central bore of the downhole tool above the plunger, the second passageway having a second outlet being exposed to the central bore of the downhole tool below the plunger;

a device configured to apply a moving force against the sliding sleeve, wherein when a pressure force created by flowing fluid through the inner diameter of the downhole tool is greater than the moving force the sliding sleeve moves from a first mode to a second mode.

9. The system of claim 8, wherein responsive to decreasing the pressure force to be less than the moving force, the sliding sleeve moves from the second mode to the first mode.

10. The system of claim 9, wherein the pressure force is based on a ratio between the first cross sectional area and the second cross sectional area.

11. A method associated with a downhole tool comprising: forming a vent extending from an inner diameter of the downhole tool to an outer diameter of the downhole tool; positioning a sliding sleeve within the downhole tool, wherein the sliding sleeve is configured to move to cover and uncover the vent; positioning a plunger within the sliding sleeve, the plunger having a first passageway for fluid and, and the plunger being configured to create a second passageway for fluid, the first passageway extending through the plunger, the second passageway extending between an outer surface of the plunger and an inner sidewall of the downhole tool, the first passageway having a first inlet being exposed to a central bore of the downhole tool above the plunger, the first passageway having a first outlet being exposed to the central bore of the downhole tool below the plunger, the second passageway having a second inlet being exposed to the central bore of the downhole tool above the plunger, the second passageway having a second outlet being exposed to the central bore of the downhole tool below the plunger; applying a first force against the sliding sleeve; moving the sliding sleeve from a first mode to a second mode based on the first force and a second force associated with fluid flowing through the inner diameter of the downhole tool.

12. The method of claim 11, wherein the first passageway extends along a central axis of the downhole tool, the first passageway having a proximal end with a first cross sectional area and a distal end with a second cross sectional area, the first cross sectional area being different than the second cross sectional area.

13. The method of claim 12, further comprising:

closing the second passageway in a first mode when the sliding sleeve does not cover the vent; and opening the second passageway in a second mode when the sliding sleeve covers the vent.

14. The method of claim 13, wherein a second end of the plunger is angled towards the central axis of the downhole tool.

15. The method of claim 12, further comprising:

creating a Venturi effect with the first cross sectional area and the second cross sectional area, wherein a first pressure rating associated with the first cross sectional area is different than a second pressure rating associated with the second cross sectional area.

16. The method of claim 15, wherein the first force is generated by a spring, and the second force is generated by flowing fluid through the inner diameter of the downhole tool; and moving the sliding sleeve from the first mode to the second mode when the second force is greater than the first force.

17. The method of claim 16, further comprising:

decreasing the second force to be less than the first force;

moving the sliding sleeve from the second mode to the first mode.

18. The method of claim 16, wherein the second force is directly correlated to a change in fluid flow rate through the downhole tool, wherein the fluid flow rate is based a ratio between the first cross sectional area and the second cross sectional area.

19. The method of claim 12, further comprising:

equalizing, in the first mode, a first column of fluid within the tool with a second column of fluid positioned within an annulus.

20. The method of claim 12, wherein the first passageway is open in the first mode and the second mode.

* * * * *